US009405262B2

(12) United States Patent
Oi et al.

(10) Patent No.: US 9,405,262 B2
(45) Date of Patent: Aug. 2, 2016

(54) IMAGE FORMING APPARATUS ELIMINATING STATIC ELECTRICITY FROM PHOTOCONDUCTOR SURFACE

(71) Applicant: KYOCERA Document Solutions Inc., Osaka (JP)

(72) Inventors: Hironobu Oi, Osaka (JP); Hisayuki Tachibana, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/835,942

(22) Filed: Aug. 26, 2015

(65) Prior Publication Data

US 2016/0062261 A1 Mar. 3, 2016

(30) Foreign Application Priority Data

Aug. 28, 2014 (JP) ..... 2014-174240

(51) Int. Cl.
*G03G 21/08* (2006.01)
*G03G 21/00* (2006.01)

(52) U.S. Cl.
CPC ..... *G03G 21/08* (2013.01); *G03G 21/0094* (2013.01)

(58) Field of Classification Search
CPC ... G03G 21/0094; G03G 21/06; G03G 21/08; G03G 2215/0448; G03G 2215/0451; G03G 2215/0453; G03G 2215/0456; G03G 2215/0458
USPC ..... 399/128
See application file for complete search history.

(56) References Cited

U.S. PATENT DOCUMENTS 6,198,892 B1 * 3/2001 Ohara ..... G03G 21/08 399/128
7,319,835 B2 * 1/2008 Ahn ..... G03G 21/00 399/129
2008/0193163 A1 * 8/2008 Moon ..... G03G 21/08 399/129
2014/0139607 A1 * 5/2014 Hayashi ..... G03G 15/04054 347/224
2015/0309450 A1 * 10/2015 Saito ..... G03G 15/0136 396/128

FOREIGN PATENT DOCUMENTS

JP 2002251046 A * 9/2002
JP 2006235034 A * 9/2006
JP 2007-219250 A 8/2007
JP 2010210823 A * 9/2010

* cited by examiner

*Primary Examiner* — Robert Beatty

(57) ABSTRACT

An image forming apparatus includes a plurality of image forming units that charge a surface of a photoconductor to form an image, a static eliminator that outputs static elimination light to eliminate a charge remaining on the photoconductor after image formation by the image forming unit, and a controller that controls the image forming unit and the static eliminator. The static eliminator includes a light source that emits the static elimination light, a light guide unit that guides the static elimination light from the light source to the photoconductors, and outputs the guided static elimination light to surface of the photoconductors, and a light shield unit provided inside the light guide unit, or between the light guide unit and the photoconductors in an optical path between the light source and the surface of each of the photoconductors, and configured to transmit or block the static elimination light.

1 Claim, 14 Drawing Sheets

IMAGE FORMING APPARATUS ELIMINATING STATIC ELECTRICITY FROM PHOTOCONDUCTOR SURFACE

INCORPORATION BY REFERENCE

This application claims priority to Japanese Patent Application No. 2014-174240 filed on Aug. 28, 2014, the entire contents of which are incorporated by reference herein.

BACKGROUND

The present disclosure relates to an image forming apparatus, and more particularly to an image forming apparatus that eliminates static electricity from a photoconductor surface by light irradiation.

Image forming apparatuses based on Xerography are thus far known, which are configured to evenly charge a photoconductor with a charging device, form a latent image with an exposure device, visualize the latent image with toner using a developing device, transfer the toner image to a sheet with a transfer device, and fix the toner on the sheet with a fixing device. In such image forming apparatuses, a ghost may appear in the image owing to disturbance of potential on the photoconductor surface taking place before the charging process, originating from a residual charge of the previous image forming operation. Accordingly, it is a normal practice to eliminate static electricity from the photoconductor surface, before the charging process of the next image forming operation.

Many of such image forming apparatuses include a plurality of illuminating devices respectively opposed to a plurality of photoconductors used for different colors, and each configured to irradiate the photoconductor surface with static elimination light. Normally, a light source is provided for each of the illuminating devices in this type of image forming apparatuses, and hence the same number of light sources as the number of photoconductors are necessary. Therefore, a larger space is required to accommodate the plurality of light sources, which naturally leads to an increase in cost. As a solution thereto, a technique of eliminating static electricity from a plurality of photoconductors with a single light source has been disclosed.

SUMMARY

In an aspect, the disclosure proposes further improvement of the foregoing technique.

The disclosure provides an image forming apparatus including a plurality of image forming units, a static eliminator, and a controller.

The plurality of image forming units each include a photoconductor, and charge a surface of the photoconductor to form an image.

The static eliminator is provided for each of the plurality of photoconductors, and outputs static elimination light to eliminate a residual charge remaining on the surface of the photoconductor after an image formation operation of the image forming unit.

The controller controls the image forming unit and the static eliminator.

The static eliminator includes a light source, a light guide unit, and a light shield unit.

The light source emits the static elimination light.

The light guide unit guides the static elimination light emitted from the light source to the plurality of photoconductors, and outputs the guided static elimination light to the surface of the photoconductors.

The light shield unit is provided inside the light guide unit or between the light guide unit and the surface of each of the photoconductors in an optical path formed between the light source and the surface of each of the photoconductors, and transmits or blocks the static elimination light.

Further, the controller controls the static eliminator, when the image forming unit performs the image formation, so as to transmit the static elimination light to the surface of the photoconductor on which the image formation is being performed among the plurality of photoconductors, and to block the static elimination light directed to the surface of the photoconductor on which the image formation is not being performed among the plurality of photoconductors.

DETAILED DESCRIPTION

Hereafter, an image forming apparatus according to a first embodiment of the disclosure will be described with reference to the drawings.

Figure 1:
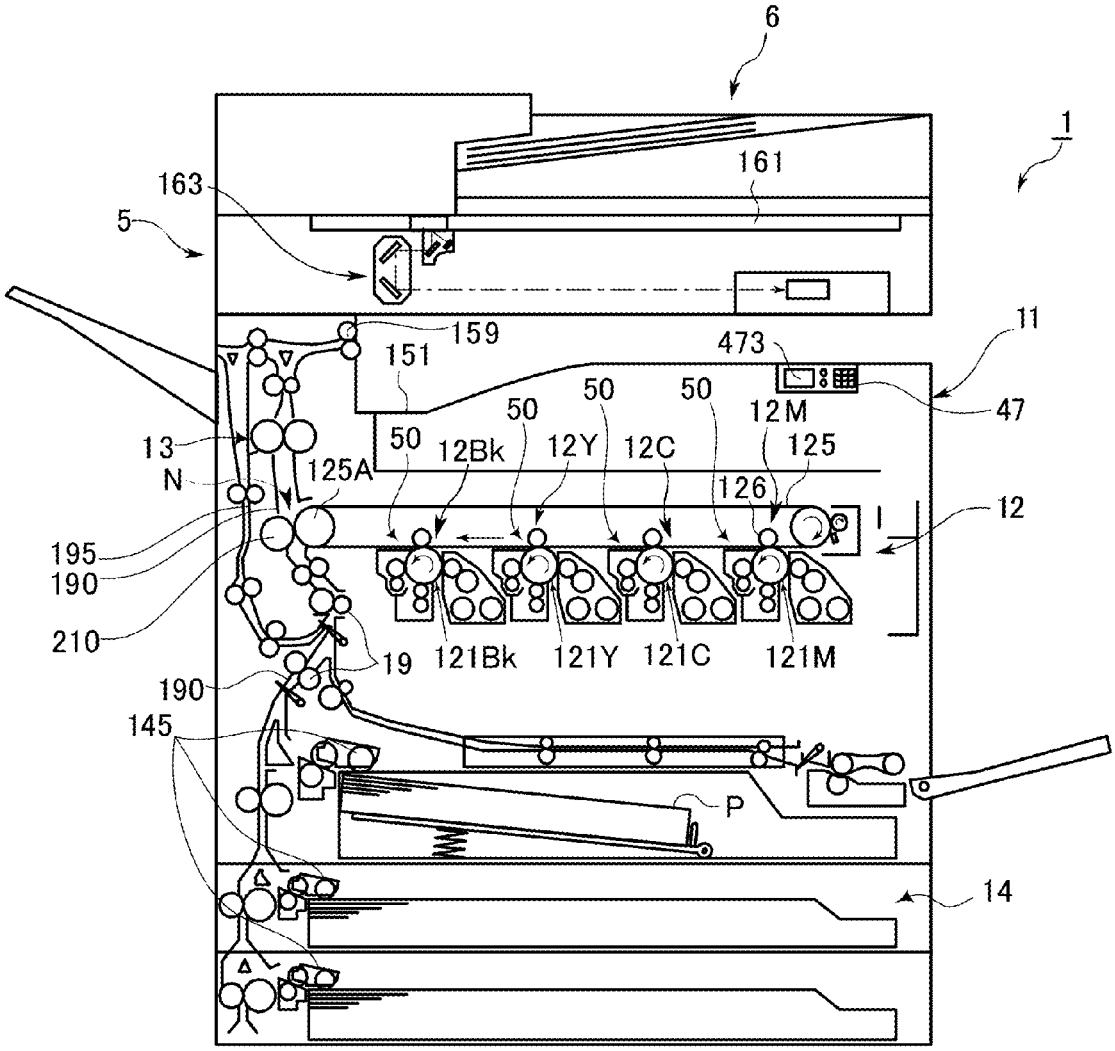
FIG. 1 is a front cross-sectional view showing a configuration of an image forming apparatus according to a first embodiment of the disclosure.

FIG. 1 is a front cross-sectional view showing a configuration of an image forming apparatus according to the first embodiment of the disclosure. The image forming apparatus 1 according to the first embodiment of the disclosure is a multifunction peripheral having a plurality of functions, such as copying, printing, scanning, and facsimile transmission. The image forming apparatus 1 includes an operation unit 47, an image forming unit 12, a fixing unit 13, a paper feed unit 14, a document feeder 6, and a document reading unit 5, which are mounted inside a main body 11.

The operation unit 47 receives instructions from the user, for operations and processes that the image forming apparatus 1 is configured to perform, such as image forming and document reading. The operation unit 47 includes a display unit 473 for displaying a guidance and so forth to the operator.

When the image forming apparatus 1 performs the document reading operation, the document reading unit 5 optically reads the image on a source document delivered from the document feeder 6 or placed on a platen glass 161, and generates image data. The image data generated by the document reading unit 5 is stored in a built-in HDD or a computer connected to a network.

When the image forming apparatus 1 performs the image forming operation, the image forming unit 12 forms a toner image on a sheet P serving as a recording medium and delivered from the paper feed unit 14, on the basis of the image data generated in the document reading operation and received from the computer connected to the network, or stored in the built-in HDD. In the case of color printing, an image forming subunit 12M for magenta, an image forming subunit 12C for cyan, an image forming subunit 12Y for yellow, and an image forming subunit 12Bk for black in the image forming unit 12 form a toner image based on the corresponding color component, on photoconductor drums 121M, 121C, 121Y, and 121Bk respectively, through charging, exposing, and developing processes, and the toner image is transferred onto an intermediate transfer belt 125 via a primary transfer roller 126. In the case of monochrome printing, the image forming subunit 12Bk for black in the image forming unit 12 forms a toner image based on the image represented by the image data on the photoconductor drum 121Bk through charging, exposing, and developing processes, and the toner image is transferred onto the intermediate transfer belt 125 via the primary transfer roller 126. The image forming subunit 12M, the image forming subunit 12C, the image forming subunit 12Y and the image forming subunit 12Bk are examples of the image forming unit in the disclosure.

The image forming apparatus 1 includes the four photoconductor drums 121M, 121C, 121Y, and 121Bk, to form the four toner images of magenta (M), cyan (C), yellow (Y), and black (Bk), respectively. The photoconductor drums 121M, 121C, 121Y, and 121Bk are examples of the photoconductor in the disclosure. A static eliminator 50 is provided for each of the photoconductor drums 121M, 121C, 121Y, and 121Bk, to emit static elimination light for eliminating electric charge on the surface of the photoconductor drums 121M, 121C, 121Y, and 121Bk, remaining after the image formation with the image forming subunit 12M, the image forming subunit 12C, the image forming subunit 12Y, and the image forming subunit 12Bk.

The toner images of the respective colors are superposed at an adjusted timing when transferred onto the intermediate transfer belt 125, so as to form a colored toner image. A secondary transfer roller 210 transfers the colored toner image formed on the surface of the intermediate transfer belt 125 onto the sheet P transported along a transport route 190 from the paper feed unit 14, at a nip region N of a drive roller 125A engaged with the intermediate transfer belt 125. Then the fixing unit 13 fixes the toner image on the sheet P by thermal pressing. The sheet P having the colored image formed and fixed thereon is discharged to an output tray 151.

The paper feed unit 14 includes a plurality of paper feed cassettes. A controller 100 (see FIG. 3) rotates a pickup roller 145 of one of the paper feed cassettes in which the sheets of the size designated by the operator are placed, to thereby transport the sheet P in the paper feed cassette toward the nip region N.

In the case of performing duplex printing with the image forming apparatus 1, the sheet P having an image formed by the image forming unit 12 on one of the surfaces is nipped between a discharge roller pair 159, and then switched back by the discharge roller pair 159 to be delivered to a reverse transport route 195 and is again transported by a transport roller pair 19 to the upstream side with respect to the nip region N and the fixing unit 13 in the transport direction of the sheet P. Thus, the image is formed by the image forming unit 12 on the other surface of the sheet P.

Figure 2A:
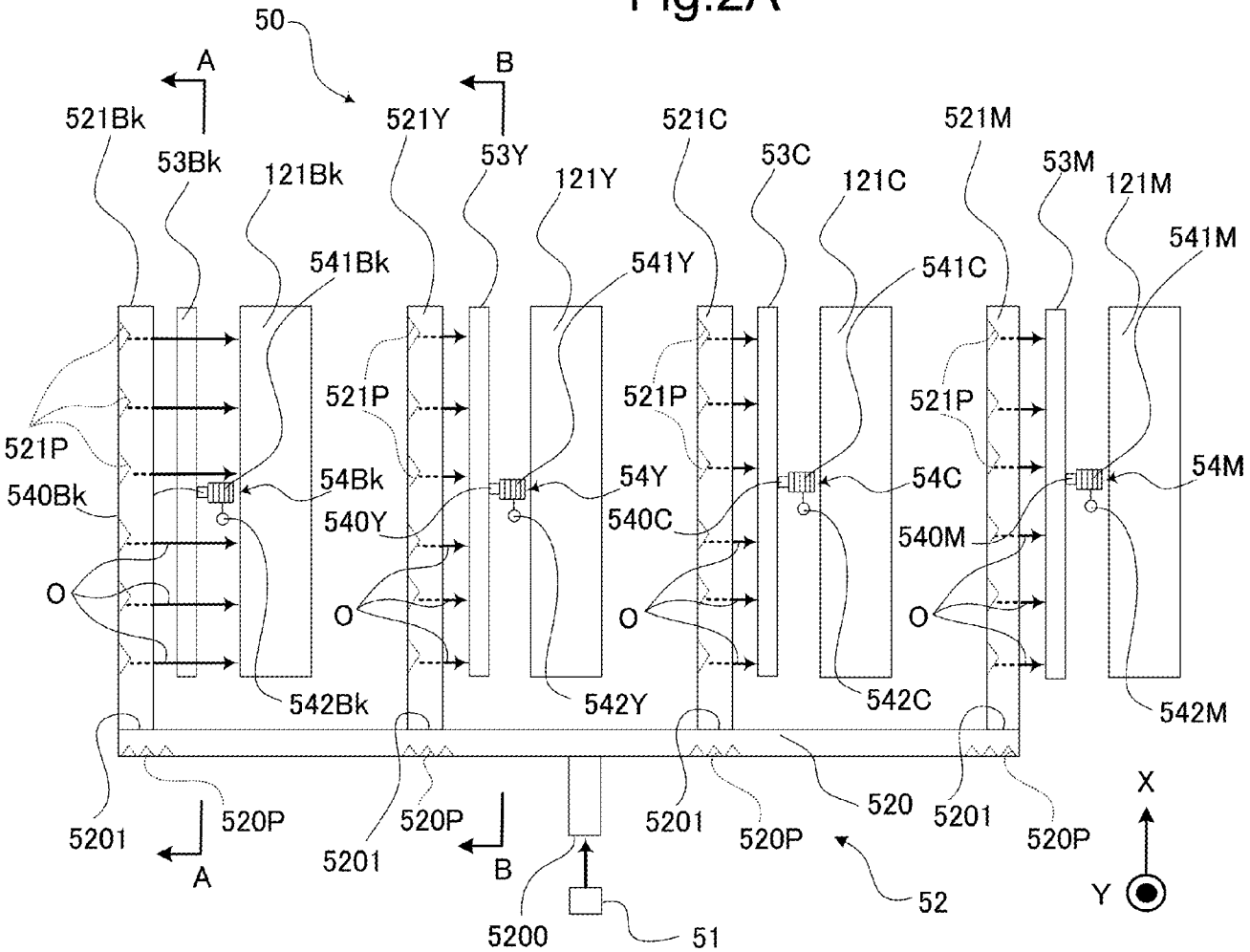
FIG. 2A is a side view of a static eliminator according to the first embodiment of the disclosure.
Figure 2B:
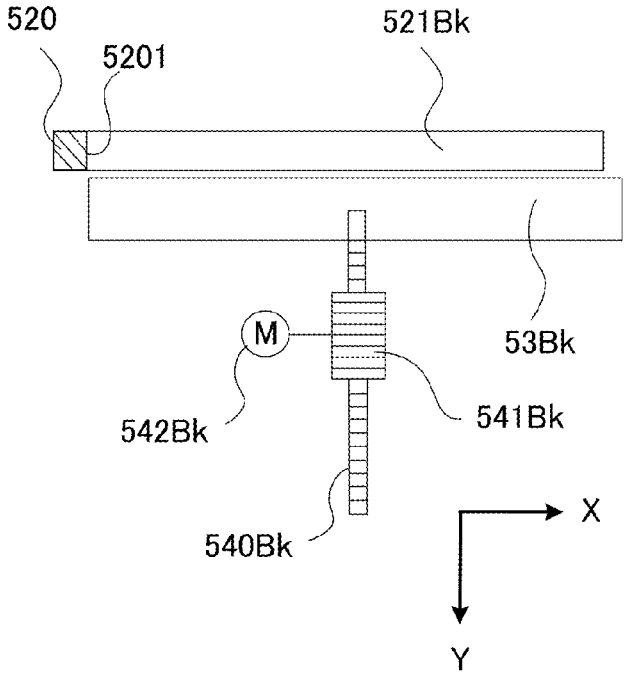
FIG. 2B is a cross-sectional view taken along a line A-A in FIG. 2A and showing a light shield unit located at an emitting position.
Figure 2C:
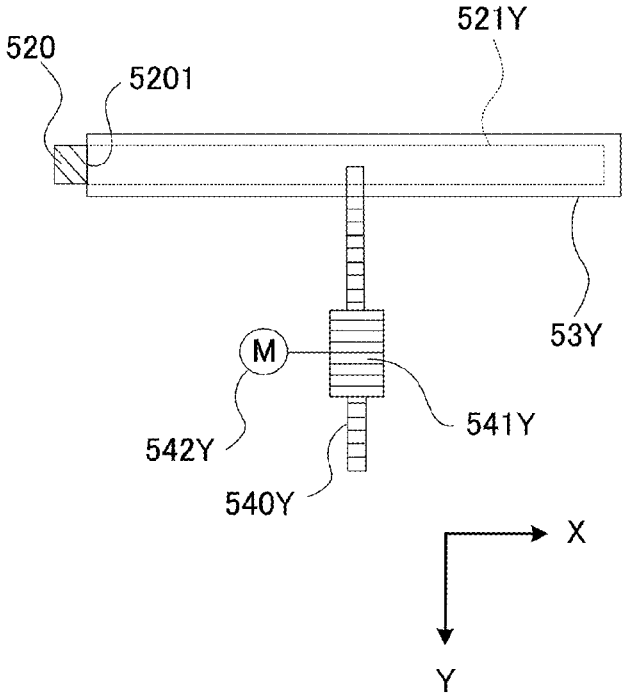
FIG. 2C is a cross-sectional view taken along a line B-B in FIG. 2A and showing the light shield unit located at a shielding position.

FIG. 2A is a side view of a static eliminator according to the first embodiment of the disclosure. FIG. 2B is a cross-sectional view taken along a line A-A in FIG. 2A. FIG. 2C is a cross-sectional view taken along a line B-B in FIG. 2A. As shown in FIG. 2A, the static eliminator 50 includes a single light source 51, a light guide unit 52, and light shield units 53M, 53C, 53Y, and 53Bk. An arrow X in FIG. 2A indicates the longitudinal direction of light emitters 521M, 521C, 521Y, and 521Bk respectively extending parallel to the photoconductor drums 121M, 121C, 121Y, and 121Bk, and a directional symbol Y indicates the direction orthogonal to the longitudinal direction of the light emitters 521M, 521C, 521Y, and 521Bk.

The light source 51 is constituted of a light emitting diode (LED) for example, and emits the static elimination light.

The light guide unit 52 serves to guide the static elimination light emitted from the light source 51 toward the photoconductor drums 121M, 121C, 121Y, and 121Bk, and emits the guided static elimination light onto the surface of the photoconductor drums 121M, 121C, 121Y, and 121Bk. The light guide unit 52 includes a distribution member 520 having branch portions 5201 that respectively distribute the static elimination light emitted from the light source 51 to the photoconductor drums 121M, 121C, 121Y, and 121Bk, and the light emitters 521M, 521C, 521Y, and 521Bk.

The distribution member 520 extends in a direction orthogonal to the axial direction of the photoconductor drums 121M, 121C, 121Y, and 121Bk. The distribution member 520 includes, for example, a light inlet 5200 protruding toward the light source 51 from a central portion in the extending direction of the distribution member 520. The distribution member 520 is constituted of, for example, a light-transmissive resin material. The distribution member 520 includes, as shown in FIG. 2A, a plurality of reflection patterns 520P each constituted of an inverted V-shaped prism projecting toward the corresponding branch portion 5201, from one of the sides of the distribution member 520. The reflection patterns 520P each reflect the static elimination light that has entered the distribution member 520 through the light inlet 5200 in a direction orthogonal to the longitudinal direction of the distribution member 520 (toward the photoconductor drums 121M, 121C, 121Y, and 121Bk), to thereby conduct the static elimination light to the light emitters 521M, 521C, 521Y, and 521Bk.

The light emitters 521M, 521C, 521Y, and 521Bk are respectively opposed to the photoconductor drums 121M, 121C, 121Y, and 121Bk, with a predetermined gap therebetween. The light emitters 521M, 521C, 521Y, and 521Bk are each disposed in a longitudinal direction so as to extend along the rotational axis (X-direction) of the photoconductor drums 121M, 121C, 121Y, and 121Bk. An end portion of each of the light emitters 521M, 521C, 521Y, and 521Bk in the longitudinal direction is connected to the corresponding branch portion 5201 of the distribution member 520, so that the static elimination light distributed by the branch portion 5201 is introduced into each of the light emitters 521M, 521C, 521Y, and 521Bk. The light emitters 521M, 521C, 521Y, and 521Bk emit the static elimination light distributed as above, to the photoconductor drums 121M, 121C, 121Y, and 121Bk, respectively. The light emitters 521M, 521C, 521Y, and 521Bk are formed of the same material as the distribution member 520. The light emitters 521M, 521C, 521Y, and 521Bk each include a reflection pattern 521P constituted of an inverted V-shaped prism like those shown in FIG. 2A, and formed on the face opposite to the face opposed to the corresponding one of the photoconductor drums 121M, 121C, 121Y, and 121Bk. The reflection patterns 521P serve to reflect the static elimination light that has entered the light emitters 521M, 521C, 521Y, and 521Bk through the distribution member 520 in a direction orthogonal to the longitudinal direction of the light emitters 521M, 521C, 521Y, and 521Bk (toward the photoconductor drums 121M, 121C, 121Y, and 121Bk), to thereby conduct the static elimination light to the light emitters 521M, 521C, 521Y, and 521Bk. A plurality of arrows O in FIG. 2A each indicate the optical path of the light reflected by each of the reflection patterns 521P toward the surface of the corresponding one of the photoconductor drums 121M, 121C, 121Y, and 121Bk.

The light shield units 53M, 53C, 53Y, and 53Bk are formed of a non-transmissive material. The light shield units 53M, 53C, 53Y, and 53Bk are respectively located between the pairs of the light emitters 521M, 521C, 521Y, and 521Bk and the photoconductor drums 121M, 121C, 121Y, and 121Bk, in the optical path from the light source 51 to the surface of the respective photoconductor drums 121M, 121C, 121Y, and 121Bk. The light shield units 53M, 53C, 53Y, and 53Bk serve to transmit or block the static elimination light emitted from the light emitters 521M, 521C, 521Y, and 521Bk, respectively. The light shield units 53M, 53C, 53Y, and 53Bk each include a moving mechanism. The moving mechanisms 54M, 54C, 54Y, and 54Bk move the respective light shield units 53M, 53C, 53Y, and 53Bk to an emitting position deviated from the optical path of the static elimination light emitted from the light emitters 521M, 521C, 521Y, and 521Bk, or to a shielding position where the light shield units 53M, 53C, 53Y, and 53Bk interfere with the optical path of the static elimination light directed toward the photoconductor drums 121M, 121C, 121Y, and 121Bk respectively, to thereby block the static elimination light. For example, the moving mechanism 54M includes a moving element 540M having a rack, a pinion gear 541M meshed with the rack of the moving element 540M, and an electric motor 542M that serves as a drive source for independently rotating the pinion gear 541M. Like the moving mechanism 54M, the moving mechanisms 54C, 54Y, and 54Bk respectively include moving elements 540C, 540Y, and 540Bk, pinion gears 541C, 541Y, and 541Bk, and electric motors 542C, 542Y, and 542Bk. The light shield units 53M, 53C, 53Y, and 53Bk are respectively attached to the moving elements 540M, 540C, 540Y, and 540Bk, so as to linearly move together with the moving elements 540M, 540C, 540Y, and 540Bk by the rotation of the pinion gears 541M, 541C, 541Y, and 541Bk, thus to be positioned at the emitting position or the shielding position.

Figure 3:
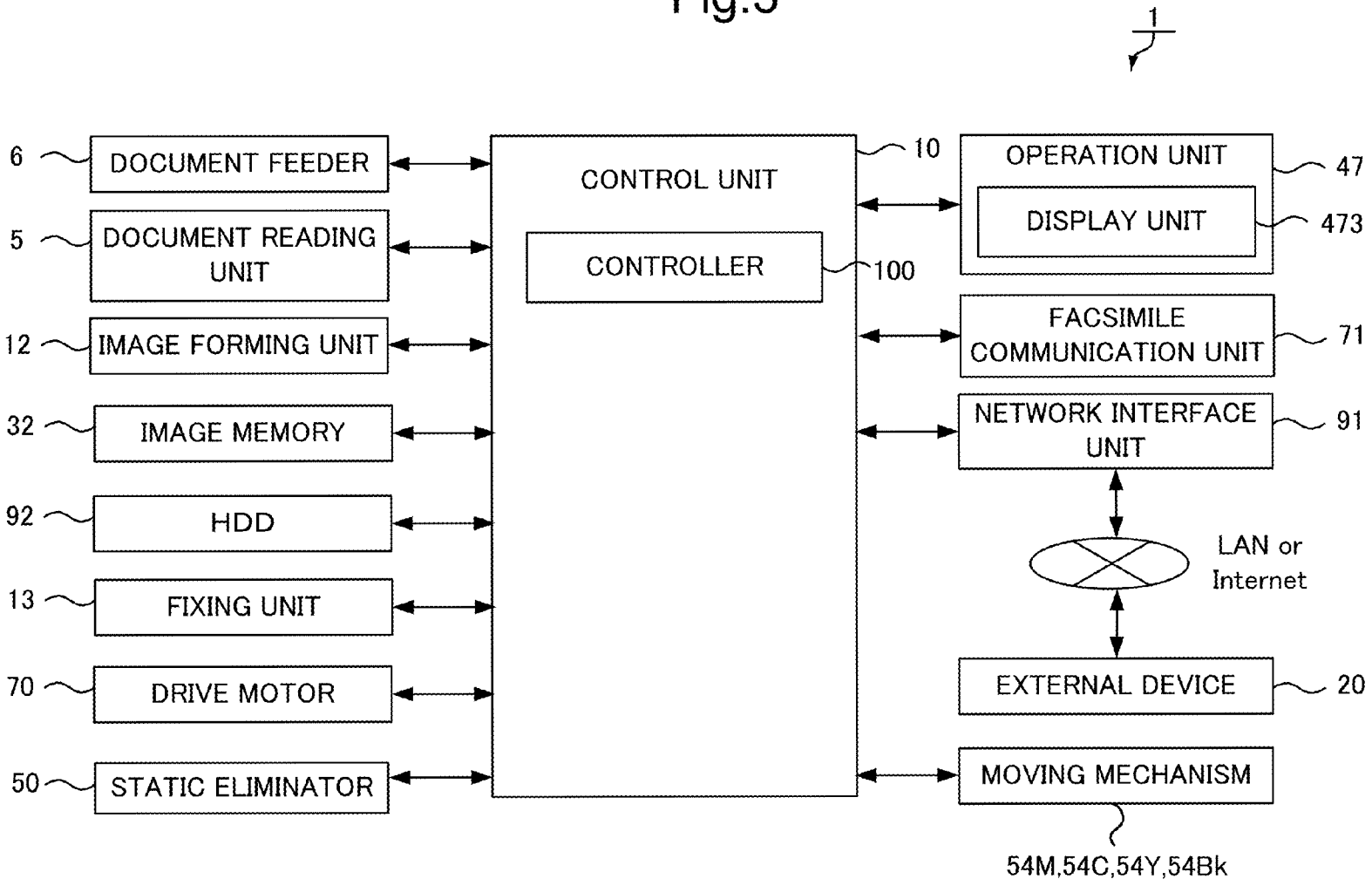
FIG. 3 is a functional block diagram showing an essential internal configuration of the image forming apparatus according to the first embodiment of the disclosure.

The moving mechanisms 54M, 54C, 54Y, and 54Bk are controlled by the controller 100 (see FIG. 3). In the case of the monochrome printing, for example, the controller 100 causes the moving elements 540M, 540C, and 540Y to linearly move in the Y-direction, the moving elements 540M, 540C, and 540Y being respectively connected to the light shield units 53M, 53C, and 53Y corresponding to the photoconductor drums 121M, 121C, and 121Y on which the image formation is not being performed by the image forming subunit 12M, the mage forming subunit 12C, and the image forming subunit 12Y respectively, to thereby move the light shield units 53M, 53C, and 53Y to the shielding position. FIG. 2C illustrates the light shield unit 53Y which has reached the shielding position. In the case of the monochrome printing, further, the controller 100 causes the moving element 540Bk to linearly move in the Y-direction, the moving element 540Bk being connected to the light shield unit 53Bk corresponding to the photoconductor drum 121Bk on which the image formation is being performed by the image forming subunit 12Bk, to thereby move the light shield unit 53Bk to the emitting position. FIG. 2B illustrates the light shield unit 53Bk which has reached the emitting position.

FIG. 3 is a functional block diagram showing an essential internal configuration of the image forming apparatus 1. The image forming apparatus 1 includes a control unit 10, the document feeder 6, the document reading unit 5, the image forming unit 12, an image memory 32, a HDD 92, the fixing unit 13, a drive motor 70, the operation unit 47, a facsimile communication unit 71, a network interface unit 91, the static eliminator 50, and moving mechanisms 54M, 54C, 54Y, and 54Bk. The constituents described above with reference to FIG. 1 are given the same numeral, and the description thereof will not be repeated.

The document reading unit 5 includes a reading mechanism 163 (see FIG. 1) including a light emitting unit and a CCD sensor, to be controlled by the control unit 100 in the controller 10. The document reading unit 5 illuminates the source document with the light from the light emitting unit and detects the reflected light with the CCD sensor, to thereby read the image on the source document.

The image memory 32 is a region for temporarily storing the image data of the source document acquired by the document reading unit 5, and data to be printed by the image forming unit 12.

The HDD 92 is a large-capacity storage device for storing source images acquired by the document reading unit 5, and so forth.

The driving motor 70 is a drive source that provides a rotational driving force to rotational components and the transport roller pair 19 of the image forming unit 12.

The facsimile communication unit 71 includes, though not shown, an encoding/decoding unit, a modem, and a network control unit (NCU), to perform facsimile transmission through a public circuit.

The network interface unit 91 includes a communication module such as a LAN board, to transmit and receive data to and from an external device 20 such as a personal computer in the local area or in the Internet, through the LAN connected to the network interface unit 91.

The control unit 10 includes a central processing unit (CPU), a RAM, a ROM, and an exclusive hardware circuit. The control unit 10 includes the controller 100. The controller 100 serves to control the overall operation of the image forming apparatus 1.

In the case of the monochrome printing, for example, the controller 100 controls the static eliminator 50 so as to allow the light shield unit 53Bk to transmit the static elimination light emitted from the light guide unit 52 to the surface of the photoconductor drum 121Bk on which the image formation is being performed, among the photoconductor drums 121M, 121C, 121Y, and 121Bk, and to cause the light shield units 53M, 53C, and 53Y to block the static elimination light, when it is necessary to block the light directed to the surface of the photoconductor drums 121M, 121C, and 121Y on which the image formation is not being performed. To be more detailed, the controller 100 controls the moving mechanism 54Bk to drive the electric motor 542Bk so as to linearly move the moving element 540Bk connected to the light shield unit 53Bk in the Y-direction, thereby moving the light shield unit 53Bk to the emitting position. At this point, the light shield unit 53Bk is deviated from the optical path of the static elimination light emitted from the light emitter 521Bk. Accordingly, the static elimination light reaches the photoconductor drum 121Bk. In addition, the controller 100 controls the moving mechanisms 54M, 54C, and 54Y to drive the electric motors 542M, 542C, and 542Y so as to linearly move the moving elements 540M, 540C, and 540Y respectively connected to the light shield units 53M, 53C, and 53Y in the Y-direction, thereby moving the light shield units 53M, 53C, and 53Y to the shielding position. At this point, the light shield units 53M, 53C, and 53Y respectively interfere with the optical path of the static elimination light toward the surface of the photoconductor drums 121M, 121C, and 121Y thus to block the static elimination light. Therefore, the static elimination light is restricted from being transmitted to the surface of the photoconductor drums 121M, 121C, and 121Y.

The control unit 10 acts as the controller 100 by operating in accordance with an image processing program installed in the HDD 92. However, the controller 100 may be constituted of hardware circuits instead of the operation by the control unit 10 in accordance with the image processing program. This also applies to other embodiments, unless otherwise specifically noted.

Figure 4:
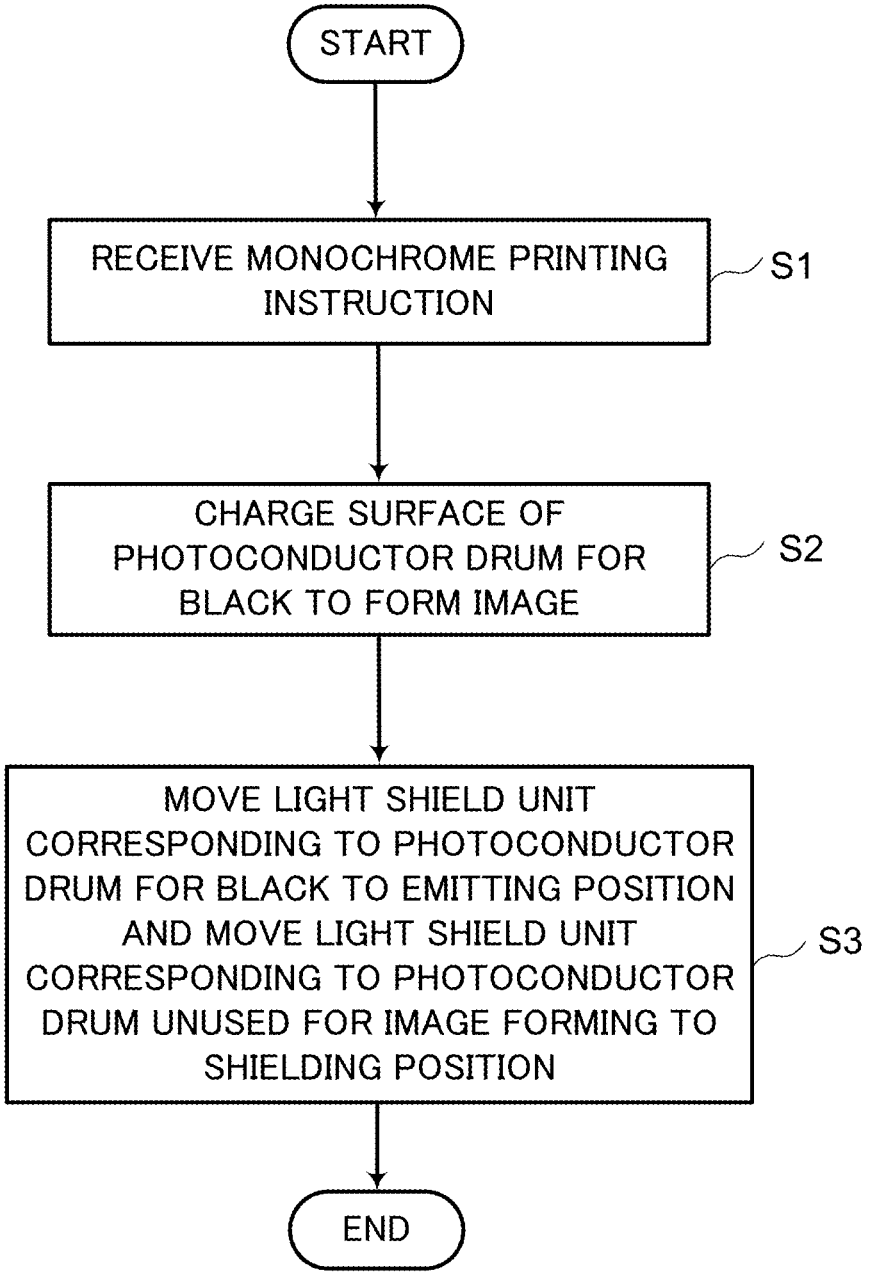
FIG. 4 is a flowchart showing an image forming process and a static elimination process according to the first embodiment of the disclosure.

Referring now to FIG. 4, description will be given about the image forming operation and the static elimination for the photoconductor according to the first embodiment of the disclosure. FIG. 4 is a flowchart showing the image forming process and the static elimination process according to the first embodiment of the disclosure.

Upon receipt of an instruction to perform the monochrome printing (S1), the controller 100 controls the image forming subunit 12Bk for black so as to charge the surface of the photoconductor drum 121Bk, thereby forming an image (S2). In this image forming process, only the photoconductor drum 121Bk is charged, and the remaining photoconductor drums 121M, 121C, and 121Y are not charged. Then the controller 100 controls the moving mechanism 54Bk so as to move the light shield unit 53Bk, corresponding to the photoconductor drum 121Bk charged by the image forming subunit 12Bk, to the emitting position, and controls the moving mechanisms 54M, 54C, 54Y so as to move the light shield units 53M, 53C, and 53Y respectively corresponding to the photoconductor drums 121M, 121C, and 121Y on which the image formation is not being performed, to the shielding position (S3). The controller 100 then receives an instruction to finish the operation, and finishes the image forming process and the static elimination process for the photoconductor.

In the first embodiment, as described above, when the monochrome printing is performed for example, the controller 100 controls the moving mechanisms 54M, 54C, 54Y so as to move the light shield units 53M, 53C, and 53Y, respectively corresponding to the photoconductor drums 121M, 121C, and 121Y on which the image formation is not being performed by the image forming subunit 12M, the image forming subunit 12C, and the image forming subunit 12Y, to the shielding position.

In the first embodiment, accordingly, in the case of the monochrome printing the static elimination light is not transmitted to the photoconductor drums 121M, 121C, and 121Y on which the image formation is not being performed by the image forming subunit 12M, the image forming subunit 12C, and the image forming subunit 12Y, and therefore the photoconductor drums 121M, 121C, and 121Y which are not used in the monochrome printing can be exempted from optical fatigue. Consequently, the configuration according to the first embodiment eliminates the need to drive or charge the photoconductor drums 121M, 121C, and 121Y in order to prevent the optical fatigue.

With conventional image forming apparatuses unlike the one according to this embodiment, the static elimination light is emitted not only to a photoconductor for single-color printing but also to unused photoconductors that are not charged in the single-color printing, even when the photoconductor for single-color printing is used. Accordingly, the photoconductors not used in the single-color printing may incur optical fatigue. In order to prevent the optical fatigue it is necessary to drive or charge the photoconductors that are not used in the single-color printing, which leads to shortened life span of the photoconductor.

The configuration according to this embodiment, however, enables the static elimination of a plurality of photoconductors to be performed with a single light source, and restricts the static elimination light from reaching the photoconductors that are not used in the single-color printing, thereby preventing the optical fatigue of the photoconductors. Thus, the foregoing problem can be eliminated.

Hereunder, an image forming apparatus according to a second embodiment of the disclosure will be described with reference to the drawings.

Figure 5A:
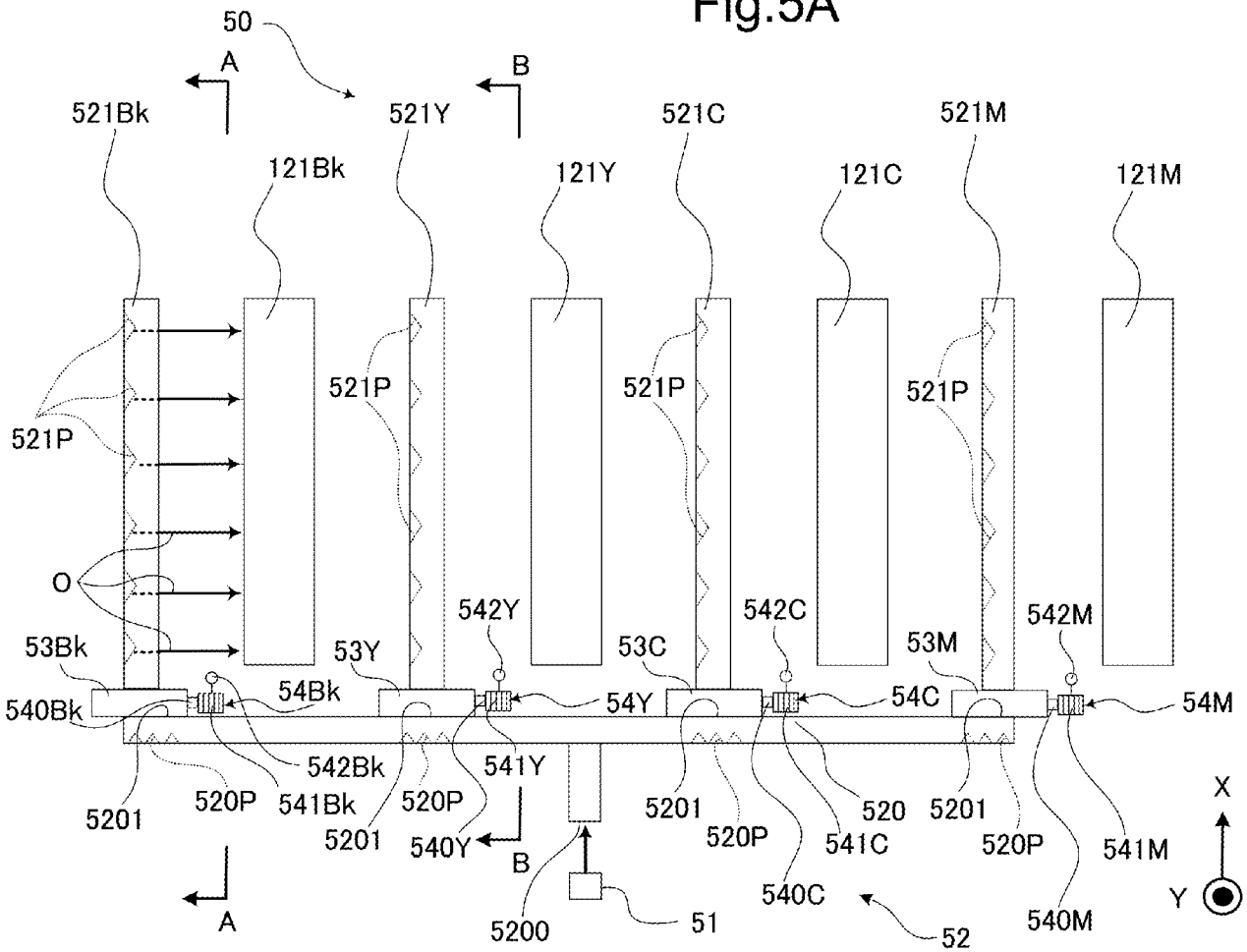
FIG. 5A is a side view of a static eliminator according to a second embodiment of the disclosure.

FIG. 5A is a side view of a static eliminator according to a second embodiment of the disclosure. The same constituents as those of the image forming apparatus according to the first embodiment will be given the same numeral, and the description thereof will not be repeated. The light shield units 53M, 53C, 53Y, and 53Bk of the first embodiment are respectively located between the pairs of the light emitters 521M, 521C, 521Y, and 521Bk and the photoconductor drums 121M, 121C, 121Y, and 121Bk (see FIG. 2), however the light shield units 53M, 53C, 53Y, and 53Bk according to the second embodiment of the disclosure are different from those of the first embodiment in being located at the corresponding branch portions 5201 of the distribution member 520, in the optical path from the light source 51 to the surface of the photoconductor drums 121M, 121C, 121Y, and 121Bk. Arrows X in FIGS. 5A to 5C indicate the longitudinal direction of light emitters 521M, 521C, 521Y, and 521Bk, and a directional symbol Y and arrows Y indicate the direction orthogonal to the longitudinal direction of the light emitters 521M, 521C, 521Y, and 521Bk.

Figure 5B:
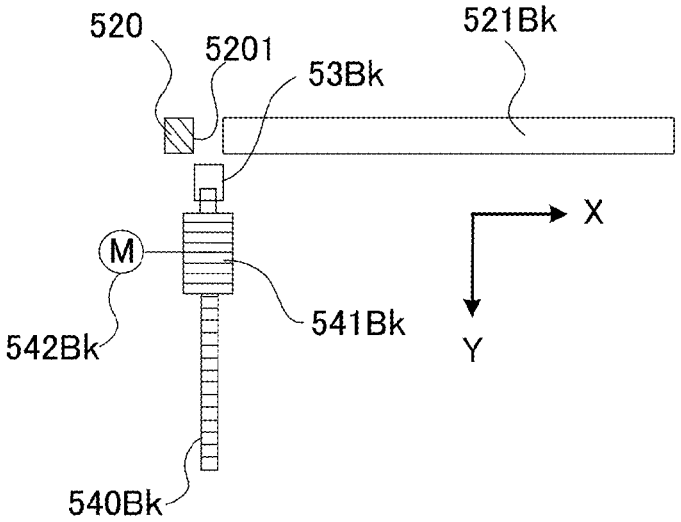
FIG. 5B is a cross-sectional view taken along a line A-A in FIG. 5A and showing the light shield unit located at the distribution position.
Figure 5C:
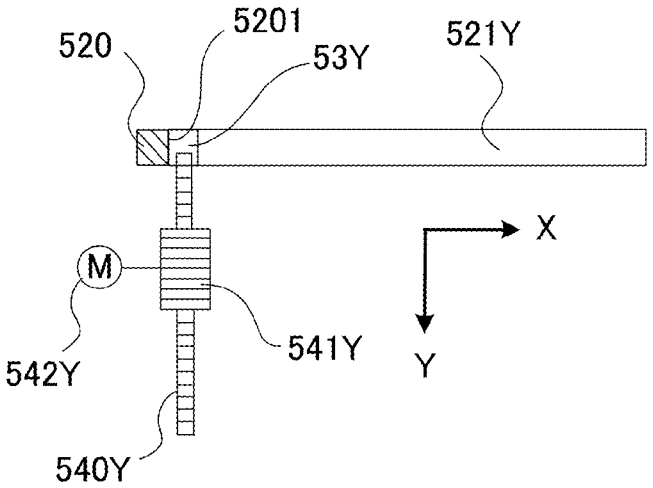
FIG. 5C is a cross-sectional view taken along a line B-B in FIG. 5A and showing the light shield unit located at the shielding position.

The moving mechanisms 54M, 54C, 54Y, and 54Bk are controlled by the controller 100 (see FIG. 3). In the case of the monochrome printing, for example, the controller 100 causes the moving elements 540M, 540C, and 540Y to linearly move in the Y-direction, the moving elements 540M, 540C, and 540Y being respectively connected to the light shield units 53M, 53C, and 53Y corresponding to the photoconductor drums 121M, 121C, and 121Y on which the image formation is not being performed by the image forming subunit 12M, the mage forming subunit 12C, and the image forming subunit 12Y respectively, among the photoconductor drums 121M, 121C, 121Y, and 121Bk, to thereby move the light shield units 53M, 53C, and 53Y to the shielding position where the light shield units 53M, 53C, and 53Y interfere with the optical path of the static elimination light directed to the light emitters 521M, 521C, and 521Y, thereby blocking the static elimination light. FIG. 5C illustrates the light shield unit 53Y which has reached the shielding position. In the case of the monochrome printing, further, the controller 100 causes the moving element 540Bk to linearly move in the Y-direction, the moving element 540Bk being connected to the light shield unit 53Bk corresponding to the photoconductor drum 121Bk on which the image formation is being performed by the image forming subunit 12Bk, among the photoconductor drums 121M, 121C, 121Y, and 121Bk, to thereby move the light shield unit 53Bk to a distribution position deviated from the optical path of the static elimination light distributed from the branch portion 5201. FIG. 5B illustrates the light shield unit 53Bk which has reached the distribution position.

In the case of the monochrome printing, for example, the controller 100 (see FIG. 3) causes the moving elements 540M, 540C, and 540Y, respectively connected to the light shield units 53M, 53C, and 53Y corresponding to the photoconductor drums 121M, 121C, and 121Y on which the image formation is not being performed, to linearly move in the Y-direction, to thereby move the light shield units 53M, 53C, and 53Y to the shielding position. At this point, the light shield units 53M, 53C, and 53Y interfere with the optical path of the static elimination light toward the light emitters 521M, 521C, and 521Y respectively, thus to block the static elimination light. Therefore, the static elimination light is restricted from being transmitted to the light emitters 521M, 521C, and 521Y. Further, the controller 100 causes the moving element 540Bk, connected to the light shield unit 53Bk corresponding to the photoconductor drum 121Bk on which the image formation is being performed, to linearly move in the Y-direction, to thereby move the light shield unit 53Bk to the distribution position. FIG. 5B illustrates the light shield unit 53Bk which has reached the distribution position. At this point, the end portion of the light emitter 521Bk on the side of the distribution member 520 is spaced from the distribution member 520. The size of the spacing may be determined so as to allow the static elimination light distributed from the distribution member 520 to be transmitted to the light emitter 521Bk. At this point, the light shield unit 53Bk is deviated from the optical path of the static elimination light distributed from the branch portion 5201. Therefore, the static elimination light can be distributed to the light emitter 521Bk from the branch portion 5201.

As described above, in the second embodiment the light shield units 53M, 53C, 53Y, and 53Bk are each located at the corresponding branch portion 5201 of the distribution member 520. The light shield units 53M, 53C, 53Y, and 53Bk can block the static elimination light directed to the photoconductor drums 121M, 121C, and 121Y from the light emitters 521M, 521C, and 521Y, simply by blocking the static elimination light from the branch portion 5201. Such an arrangement eliminates the need to provide the light shield units 53M, 53C, 53Y, and 53Bk over the entire length of the light emitter 521M, 521C, 521Y, and 521Bk in the longitudinal direction, as in the first embodiment. Consequently, the light shield units 53M, 53C, 53Y, and 53Bk can be formed in a smaller size than those of the first embodiment.

Hereunder, an image forming apparatus according to a third embodiment of the disclosure will be described with reference to the drawings.

Figure 6A:
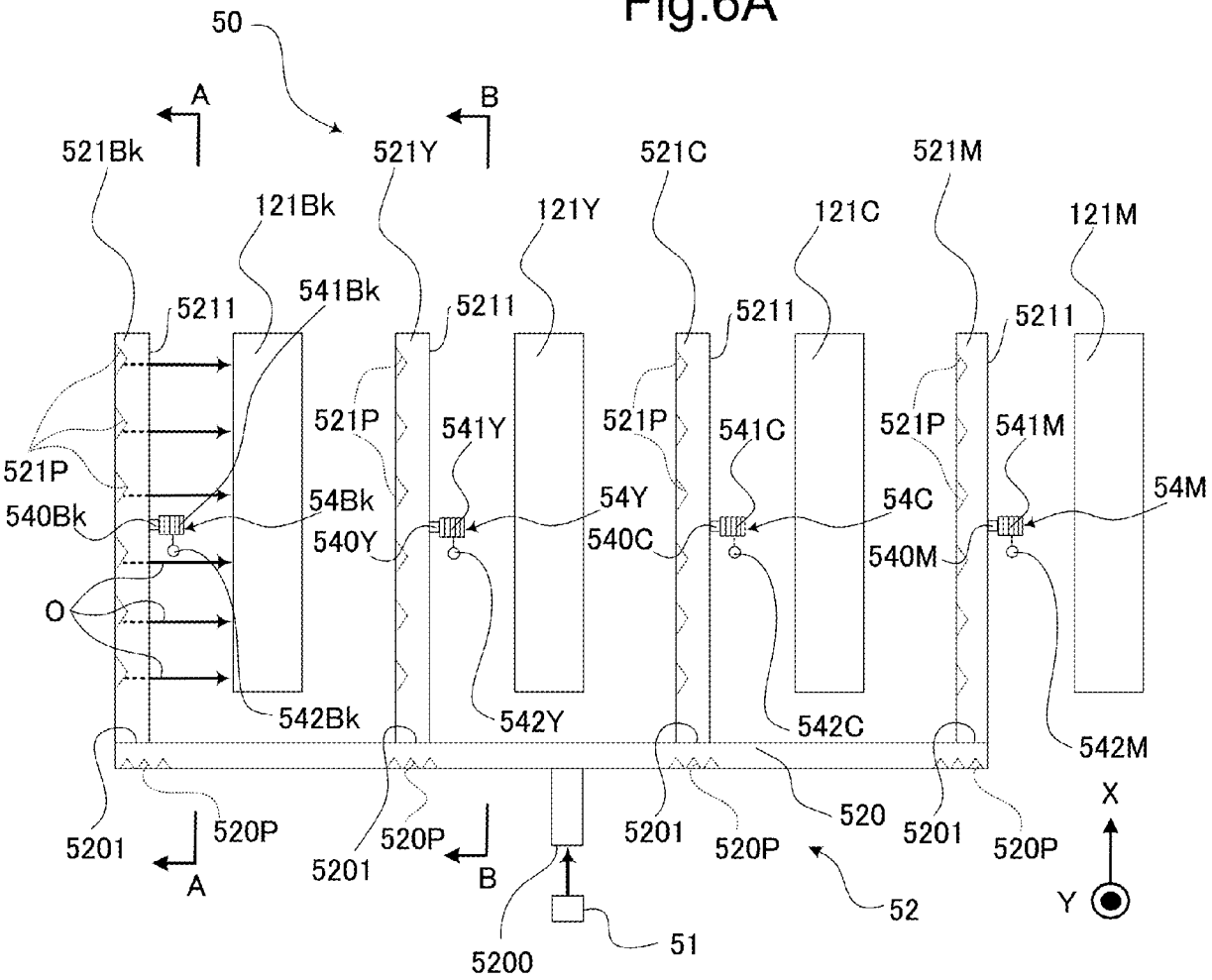
FIG. 6A is a side view of a static eliminator according to a third embodiment of the disclosure.
Figure 6B:
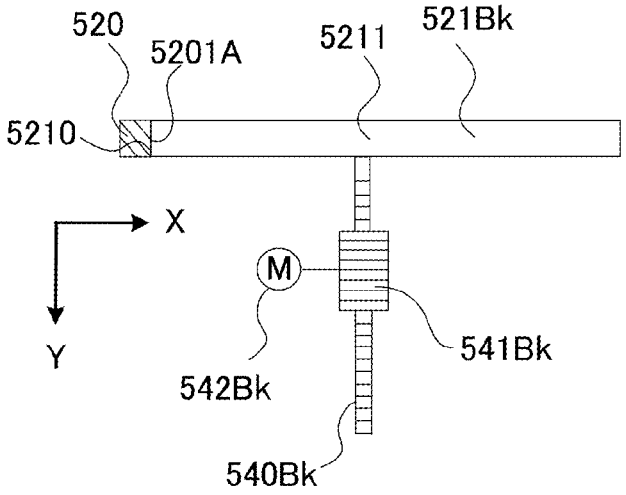
FIG. 6B is a cross-sectional view taken along a line A-A in FIG. 6A and showing the light shield unit located at the transmission position.
Figure 6C:
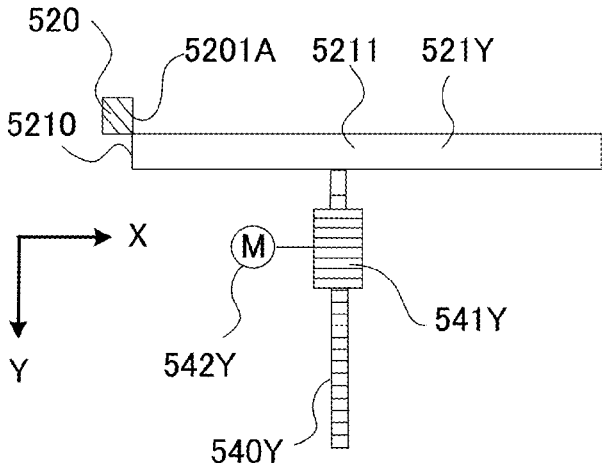
FIG. 6C is a cross-sectional view taken along a line B-B in FIG. 6A and showing the light shield unit located at the shielding position.

FIG. 6A is a side view of a static eliminator according to a third embodiment of the disclosure. FIG. 6B is a cross-sectional view taken along a line A-A in FIG. 6A. FIG. 6C is a cross-sectional view taken along a line B-B in FIG. 6A. The same constituents as those of the image forming apparatus according to the first embodiment will be given the same numeral, and the description thereof will not be repeated. In the first embodiment, the light shield units 53M, 53C, 53Y, and 53Bk are provided for transmitting or blocking the static elimination light directed to the photoconductor drums 121M, 121C, 121Y, and 121Bk (see FIG. 2). The third embodiment of the disclosure is different from the first embodiment in transmitting or blocking the static elimination light directed to the photoconductor drums 121M, 121C, 121Y, and 121Bk without utilizing the light shield units 53M, 53C, 53Y, and 53Bk.

As shown in FIG. 6A, the static eliminator 50 includes the single light source 51, the distribution member 520, the light emitters 521M, 521C, 521Y, and 521Bk, and the moving mechanisms 54M, 54C, 54Y, and 54Bk. Arrows X in FIGS. 6A to 6C indicate the longitudinal direction of light emitters 521M, 521C, 521Y, and 521Bk, and a directional symbol Y and arrows Y indicate the direction orthogonal to the longitudinal direction of the light emitters 521M, 521C, 521Y, and 521Bk.

The distribution member 520 includes branch portions 5201 that each distribute the static elimination light emitted from the light source 51 to the photoconductor drums 121M, 121C, 121Y, and 121Bk, and transmission surfaces 5201A formed on the respective branch portions 5201 so as to transmit the static elimination light. The distribution member 520 allows the static elimination light to be transmitted to the light emitters 521M, 521C, 521Y, and 521Bk only via the transmission surface 5201A, by means of the reflection pattern 521P, and the static elimination light is transmitted through no other route.

The light emitters 521M, 521C, 521Y, and 521Bk each include an incident surface 5210 and an output surface 5211. The incident surface 5210 allows the distributed static elimination light to be introduced, when the incident surface 5210 is in contact with the transmission surface 5201A. The output surfaces 5211 are respectively opposed to the photoconductor drums 121M, 121C, 121Y, and 121Bk, so as to emit the static elimination light introduced through the incident surface 5210 to the surface of the photoconductor drums 121M, 121C, 121Y, and 121Bk.

The moving mechanisms 54M, 54C, 54Y, and 54Bk respectively move the light emitters 521M, 521C, 521Y, and 521Bk to a transmission position that allows the static elimination light to be transmitted from the transmission surface 5201A of the distribution member 520 to the incident surface 5210 of the light emitters 521M, 521C, 521Y, and 521Bk, and to the shielding position that restricts the static elimination light from being transmitted from the transmission surface 5201A of the distribution member 520 to the incident surface 5210 of the light emitters 521M, 521C, 521Y, and 521Bk.

The moving mechanisms 54M, 54C, 54Y, and 54Bk are controlled by the controller 100 (see FIG. 3). In the case of the monochrome printing, for example, the controller 100 causes the moving elements 540M, 540C, and 540Y to linearly move in the Y-direction, the moving elements 540M, 540C, and 540Y being respectively connected to the light emitters 521M, 521C, and 521Y, the respective output surfaces 5211 of which are opposed to the surface of the photoconductor drums 121M, 121C, and 121Y on which the image formation is not being performed, to thereby move the light emitter 521M, 521C, and 521Y to the shielding position. FIG. 6C illustrates the light emitter 521Y which has reached the shielding position. At this point, the incident surface 5210 of the light emitter 521Y is not in contact with the transmission surface 5201A of the distribution member 520, and therefore the static elimination light is not transmitted from the transmission surface 5201A to the incident surface 5210. Accordingly, the static elimination light directed to the surface of the photoconductor drum 121Y is blocked, and thus restricted from reaching the surface of the photoconductor drum 121Y. In the case of the monochrome printing, further, the controller 100 causes the moving element 540Bk to linearly move in the Y-direction, the moving element 540Bk being connected to the light emitter 521Bk, the output surface 5211 of which is opposed to the surface of the photoconductor drum 121Bk on which the image formation is being performed, to thereby move the light emitter 521Bk to the transmission position. FIG. 6B illustrates the light emitter 521Bk which has reached the transmission position. At this point, the incident surface 5210 of the light emitter 521Bk is in contact with the transmission surface 5201A of the distribution member 520, and therefore the static elimination light is transmitted from the transmission surface 5201A to the incident surface 5210. Accordingly, the static elimination light can reach the surface of the photoconductor drum 121Bk, from the light emitter 521Bk.

As described above, in the third embodiment the controller 100 can transmit or block the static elimination light directed to the photoconductor drums 121M, 121C, 121Y, and 121Bk with a simple mechanism for moving the light emitters 521M, 521C, 521Y, and 521Bk with respect to the distribution member 520, without employing additional components such as the light shield units 53M, 53C, 53Y, and 53Bk.

Hereunder, an image forming apparatus according to a fourth embodiment of the disclosure will be described with reference to the drawings.

Figure 7A:
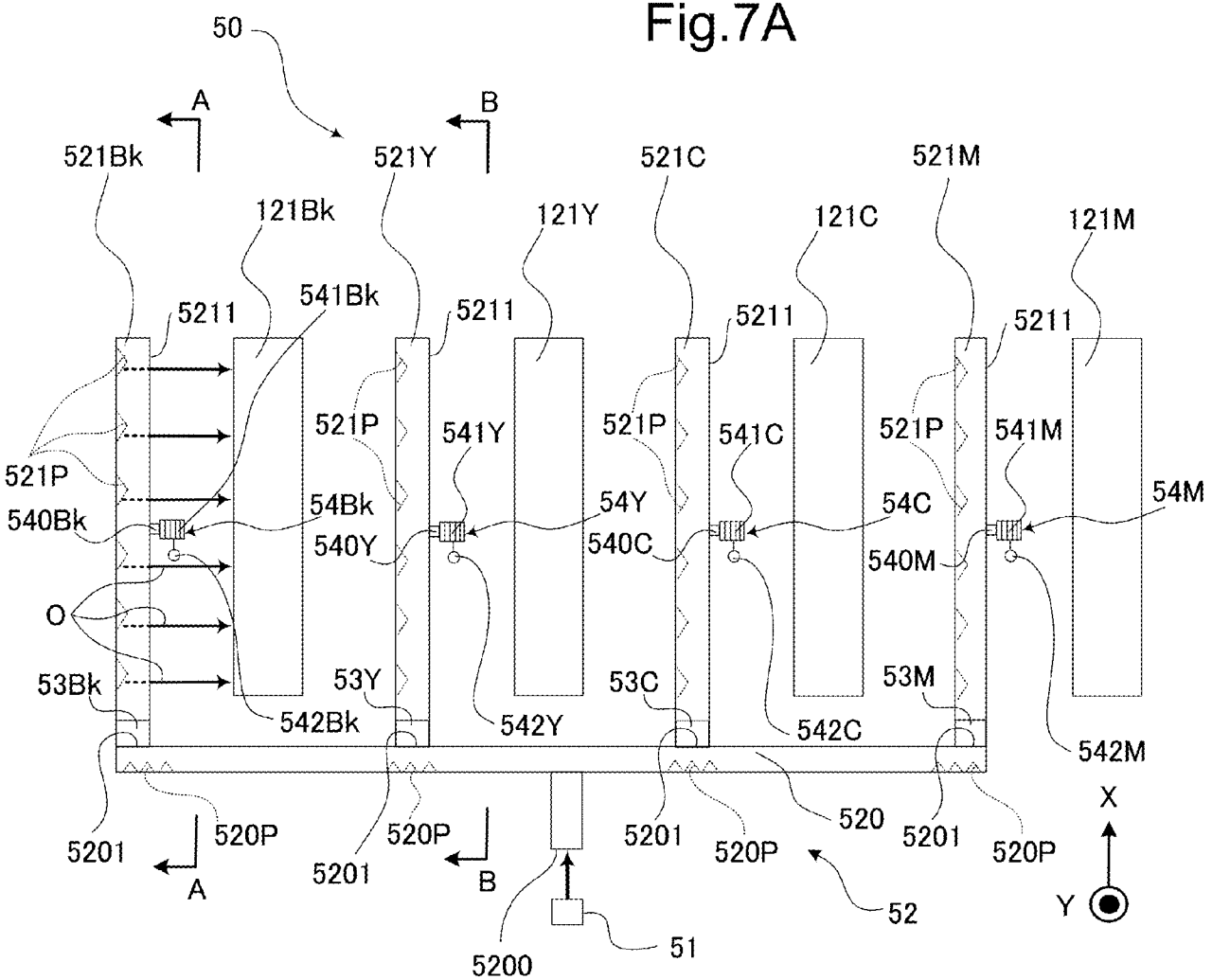
FIG. 7A is a side view of a static eliminator according to a fourth embodiment of the disclosure.
Figure 7B:
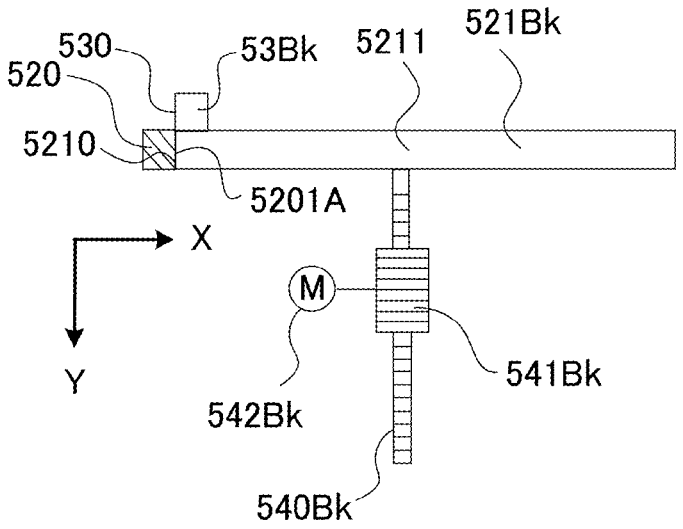
FIG. 7B is a cross-sectional view taken along a line A-A in FIG. 7A and showing the light shield unit located at the emitting position.
Figure 7C:
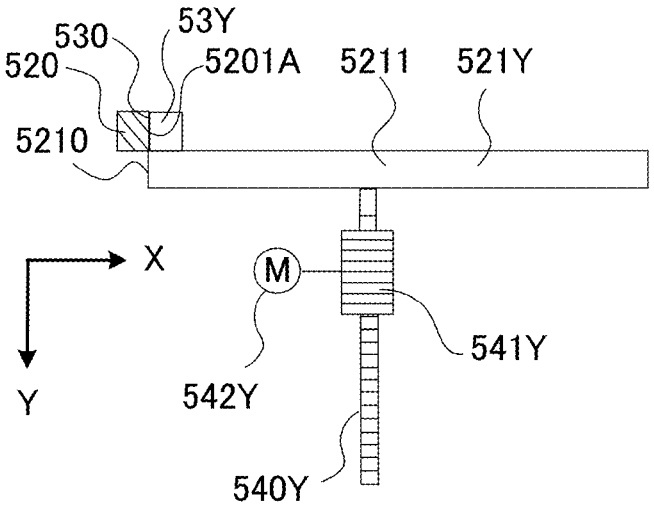
FIG. 7C is a cross-sectional view taken along a line B-B in FIG. 7A and showing the light shield unit located at the shielding position.

FIG. 7A is a side view of a static eliminator according to the fourth embodiment of the disclosure. FIG. 7B is a cross-sectional view taken along a line A-A in FIG. 7A. FIG. 7C is a cross-sectional view taken along a line B-B in FIG. 7A. The same constituents as those of the image forming apparatus according to the third embodiment will be given the same numeral, and the description thereof will not be repeated. In the third embodiment, the static elimination light directed to the photoconductor drums 121M, 121C, 121Y, and 121Bk is transmitted or blocked by moving the light emitters 521M, 521C, 521Y, and 521Bk (see FIG. 6). The fourth embodiment of the disclosure is different from the third embodiment in that shielding members 53M, 53C, 53Y, and 53Bk are provided.

As shown in FIG. 7A, the static eliminator 50 includes the single light source 51, the distribution member 520, the light emitters 521M, 521C, 521Y, and 521Bk, the shielding members 53M, 53C, 53Y, and 53Bk, and the moving mechanisms 54M, 54C, 54Y, and 54Bk. Arrows X in FIGS. 7A to 7C indicate the longitudinal direction of light emitters 521M, 521C, 521Y, and 521Bk, and a directional symbol Y and arrows Y indicate the direction orthogonal to the longitudinal direction of the light emitters 521M, 521C, 521Y, and 521Bk.

The shielding members 53M, 53C, 53Y, and 53Bk are formed of a non-transmissive material. As shown in FIGS. 7B and 7C, the shielding members 53Y and 53Bk are located adjacent to the incident surface 5210 of the respective light emitters 521Y and 521Bk, and each include a shielding surface 530 that can be moved in the Y-direction along the transmission surface 5201A of the distribution member 520 together with the incident surface 5210, so as to block the static elimination light from the distribution member 520 upon contacting the transmission surface 5201A. Although not shown in FIGS. 7B and 7C, the shielding members 53M and 53C also include the shielding surface 530 like the shielding members 53Y and 53Bk.

The moving mechanisms 54M, 54C, 54Y, and 54Bk are controlled by the controller 100 (see FIG. 3). In the case of the monochrome printing, for example, the controller 100 controls the moving mechanisms 54M, 54C, and 54Y to cause the moving elements 540M, 540C, and 540Y to linearly move in the Y-direction, the moving elements 540M, 540C, and 540Y being respectively connected to the light emitters 521M, 521C, and 521Y, the respective output surfaces 5211 of which are opposed to the surface of the photoconductor drums 121M, 121C, and 121Y on which the image formation is not being performed, to thereby move the light emitters 521M, 521C, and 521Y to the shielding position (see FIG. 7C). At this point, the respective incident surfaces 5210 of the light emitters 521M, 521C, and 521Y are in contact with the shielding surfaces 530, and therefore the static elimination light directed to the light emitters 521M, 521C, and 521Y from the distribution member 520 is blocked. Thus, the static elimination light directed to the surface of the photoconductor drums 121M, 121C, and 121Y is blocked and hence the static elimination light is restricted from being transmitted to the surface of the photoconductor drums 121M, 121C, and 121Y. FIG. 7C illustrates the light emitter 521Y which has reached the shielding position. In the case of the monochrome printing, further, the controller 100 controls the moving mechanism 54Bk to causes the moving element 540Bk to linearly move in the Y-direction, the moving element 540Bk being connected to the light emitter 521Bk, the output surface 5211 of which is opposed to the surface of the photoconductor drum 121Bk on which the image formation is being performed, to thereby move the light emitter 521Bk to the transmission position. FIG. 7B illustrates the light emitter 521Bk which has reached the transmission position. At this point, the incident surface 5210 of the light emitter 521Bk is in contact with the transmission surface 5201A of the distribution member 520, and therefore the static elimination light is transmitted from the distribution member 520 to the incident surface 5210. Accordingly, the static elimination light can reach the surface of the photoconductor drum 121Bk, from the light emitter 521Bk.

As described above, in the fourth embodiment the static elimination light directed to the light emitters 521M, 521C, and 521Y from the distribution member 520 is blocked by the respective shielding surfaces 530 of the shielding members 53M, 53C, and 53Y. Such a configuration ensures that the static elimination light is restricted from being transmitted to the surface of the photoconductor drums 121M, 121C, and 121Y from the light emitters 521M, 521C, and 521Y.

Figure 8:
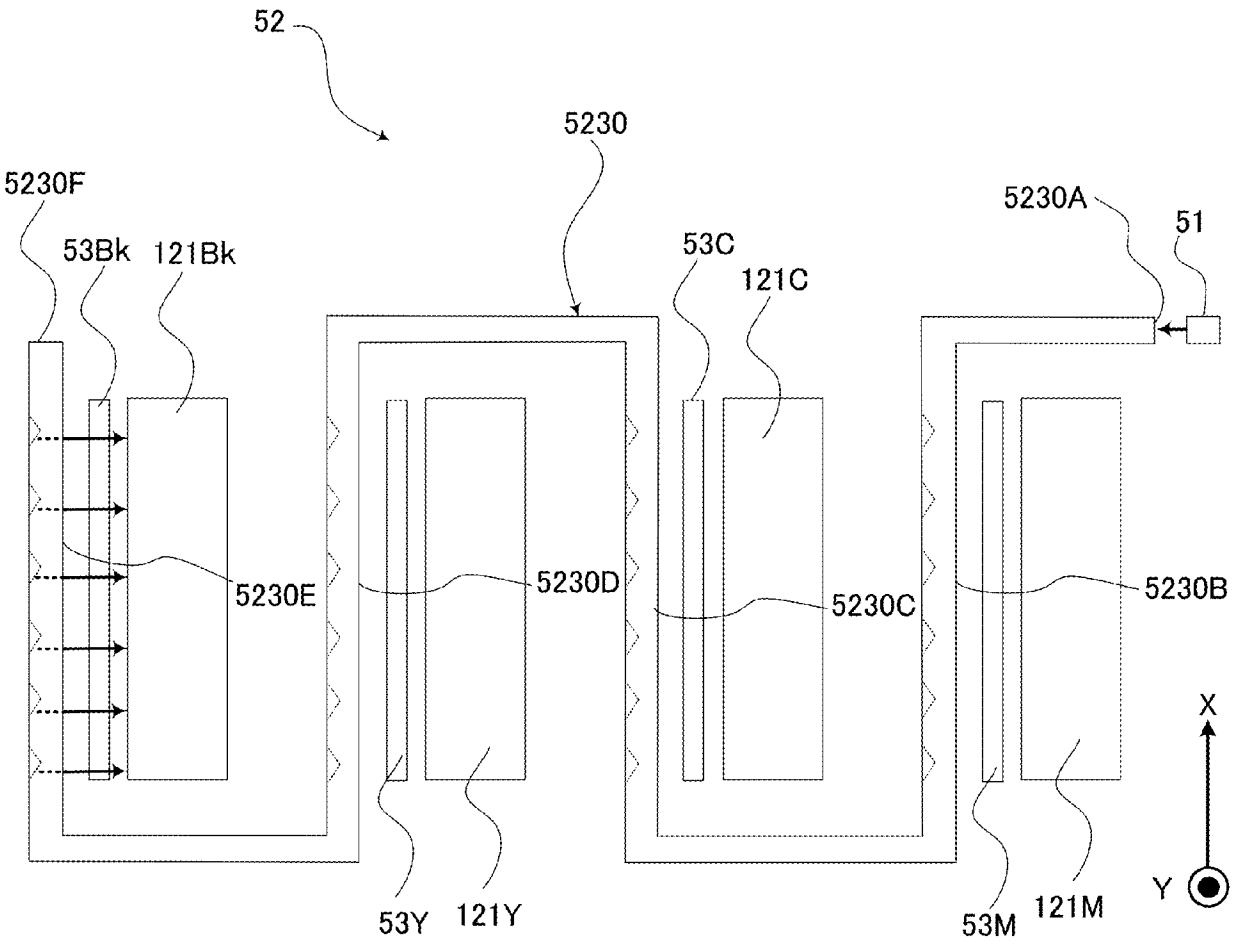
FIG. 8 is a side view of a static eliminator according to a variation of the first embodiment of the disclosure.

In the first to the fourth embodiments, the light guide unit 52 includes the distribution member 520 that distributes the static elimination light emitted from the light source 51 to the photoconductor drums 121M, 121C, 121Y, and 121Bk, and the light emitters 521M, 521C, 521Y, and 521Bk that respectively emit the static elimination light distributed by the distribution member 520 to the surface of the photoconductor drums 121M, 121C, 121Y, and 121Bk (see FIG. 2), the disclosure is not limited to the foregoing embodiments. The light guide unit 52 shown in FIG. 8 includes a passage formed from an incident end 5230A opposed to the light source 51 to the distal end 5230F of a light guide member 5230 that guides the static elimination light from the light source 51. The passage is disposed so as to oppose all of the photoconductor drums 121M, 121C, 121Y, and 121Bk, along the rotational axis of the photoconductor drums 121M, 121C, 121Y, and 121Bk, and includes the output surfaces respectively opposed to the surface of the photoconductor drums 121M, 121C, 121Y, and 121Bk. The output surfaces 5230B, 5230C, 5230D, and 5230E reflect the static elimination light toward the surface of the respective photoconductor drums 121M, 121C, 121Y, and 121Bk. In this case, the light guide unit 52 can be formed with the single light guide member 5230 alone, without the need to employ a plurality of members including the distribution member 520 and the light emitters 521M, 521C, 521Y, and 521Bk as in the first to the fourth embodiments.

Figure 9A:
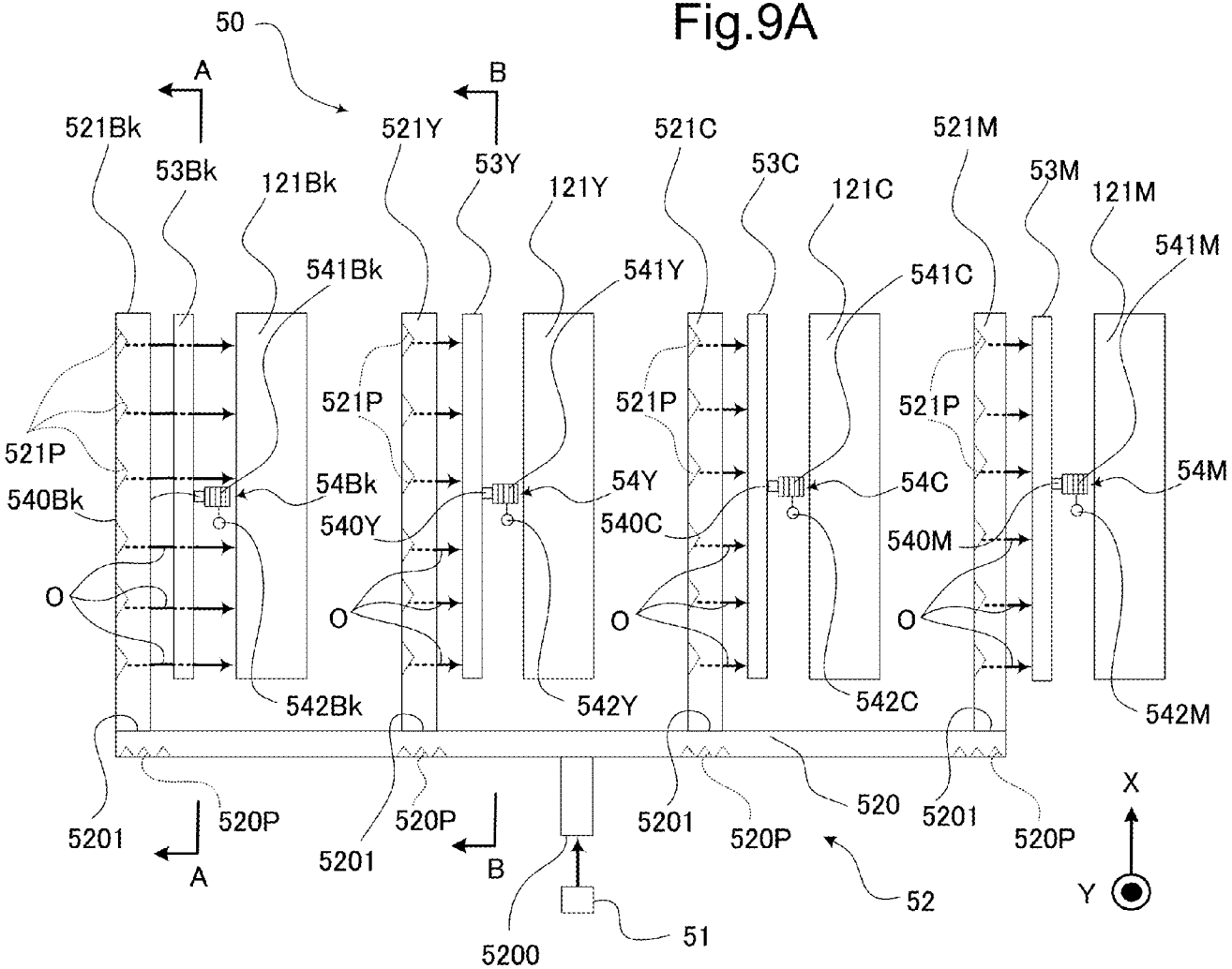
FIG. 9A is a side view of a static eliminator according to an additional embodiment of the disclosure.
Figure 9B:
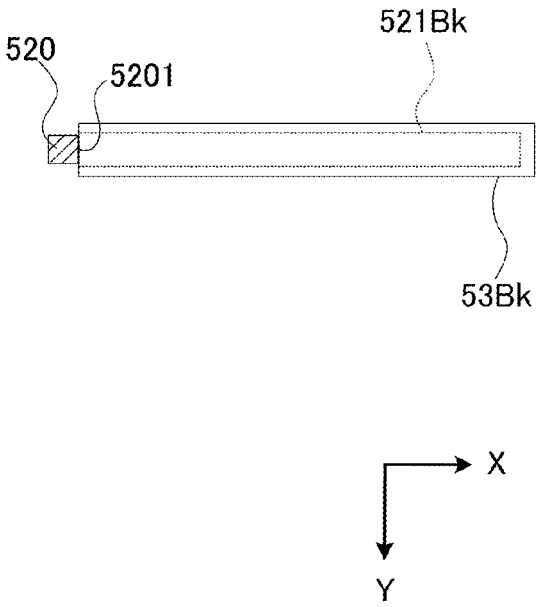
FIG. 9B is a cross-sectional view taken along a line A-A in FIG. 9A and showing the light shield unit transmitting static elimination light.
Figure 9C:
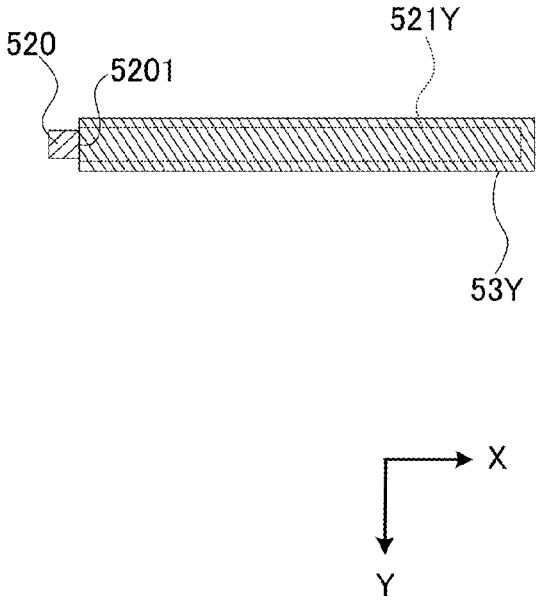
FIG. 9C is a cross-sectional view taken along a line B-B in FIG. 9A and showing the light shield unit blocking the static elimination light.

In the first and second embodiments, the controller 100 controls the moving mechanism 54 to move the light shield units 53M, 53C, 53Y, and 53Bk to the emitting position or the shielding position, to thereby transmit or block the static elimination light directed to the photoconductor drums 121M, 121C, 121Y, and 121Bk, however the disclosure is not limited to those embodiments. FIG. 9A is a side view of a static eliminator according to an additional embodiment of the disclosure. FIG. 9B illustrates the light shield unit transmitting the static elimination light. FIG. 9C illustrates the light shield unit blocking the static elimination light. For example as shown in FIG. 9A, FIG. 9B, and FIG. 9C, the light shield units 53Bk, 53Y, 53C, and 53M may each include a mechanism that transmits or blocks light by control of the orientation of liquid crystal. To be more detailed, the light shield units 53Bk, 53Y, 53C, and 53M may each include a mechanism including a pair of substrates each having an electrode on the opposing surface and a liquid crystal layer formed of liquid crystal molecules encapsulated between the pair of substrates, so as to control the orientation direction of the liquid crystal molecules by applying a first electric field or a second electric field to the pair of substrates. In this example, the controller 100 can set the orientation direction of the liquid crystal molecules parallel to the proceeding direction of the static elimination light, by applying the first electric field to the pair of substrates provided in the light shield units 53Bk, 53Y, 53C, and 53M respectively corresponding to the photoconductor drums 121M, 121C, 121Y, and 121Bk on which the image formation is being performed by the image forming subunit 12M, the image forming subunit 12C, the image forming subunit 12Y, and the image forming subunit 12Bk, to thereby transmit the static elimination light along the orientation direction of the liquid crystal molecules as shown in FIG. 9B. The controller 100 can also set the orientation direction of the liquid crystal molecules perpendicular to the proceeding direction of the static elimination light, by applying the second electric field to the pair of substrates provided in the light shield units respectively corresponding to the photoconductor drums 121M, 121C, 121Y, and 121Bk on which the image formation is not being performed by the image forming subunit 12M, the image forming subunit 12C, the image forming subunit 12Y, and the image forming subunit 12Bk, to thereby cause the liquid crystal molecules to block the static elimination light, as shown in FIG. 9C.

Further, a separation unit that can cause the intermediate transfer belt 125 to contact or move away from the photoconductor drums 121M, 121C, and 121Y for color printing may be provided. Then the light shield units 53M, 53C, and 53Y of the first embodiment may be moved to a position where the separation unit separates the intermediate transfer belt 125 from the photoconductor drums 121M, 121C, and 121Y. In this case, the light shield units 53M, 53C, and 53Y may be moved to the shielding position, in other words the separation unit may be moved to the shielding position for interfering with the optical path of the static elimination light directed to the surface of the photoconductor drums 121M, 121C, and 121Y. In addition, when the separation unit brings the intermediate transfer belt 125 into contact with the photoconductor drums 121M, 121C, and 121Y, the light shield units 53M, 53C, and 53Y may be moved together with the intermediate transfer belt 125 so as to move the light shield units 53M, 53C, and 53Y to the emitting position, in other words the position deviated from the optical path of the static elimination light emitted from the light emitters 521M, 521C, and 521Y. By moving thus the separation unit, the moving mechanisms 54M, 54C, and 54Y for moving the light shield units 53M, 53C, and 53Y to the shielding position or the emitting position can be excluded.

Further, in the first to the fourth embodiments the controller transmits or blocks the static elimination light directed to the photoconductor drums 121M, 121C, 121Y, and 121Bk, when performing the monochrome printing, however the disclosure is not limited to those embodiments. The controller may transmit or block the static elimination light directed to the photoconductor drums 121M, 121C, 121Y, and 121Bk, on which the image formation is not being performed, when the single-color printing is performed with magenta (M), cyan (C), and yellow (Y).

It is to be understood that the configurations and operations described in the foregoing embodiments with reference to FIG. 1 to FIG. 8 are merely exemplary, and in no way intended to limit the configuration and operation of the present disclosure.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a plurality of image forming units each including a photoconductor, a charging unit configured to charge a surface of the photoconductor, a exposure unit configured to expose the surface of the photoconductor having been charged by the charging unit, a developing unit configured to form a toner image on the surface of the photoconductor after the exposure by the exposure unit, a transfer unit configured to transfer the toner image to a recording medium and form an image on the recording medium;

a static eliminator provided for each of the plurality of photoconductors, and configured to output static elimination light to eliminate a residual charge remaining on the surface of the photoconductor after an image formation operation of the image forming unit; and a controller that controls the image forming unit and the static eliminator, wherein the static eliminator includes:

a light source that emits the static elimination light;

a light guide unit that guides the static elimination light emitted from the light source to the plurality of photoconductors, and outputs the guided static elimination light to the surface of the photoconductors; and a light shield unit provided between the light guide unit and the surface of each of the photoconductors in an optical path formed between the light source and the surface of each of the photoconductors, and configured to transmit or block the static elimination light, wherein the light shield unit includes a mechanism including a pair of substrates each having an electrode on a surface opposing each other and a liquid crystal layer formed of liquid crystal molecules encapsulated between the pair of substrates, and configured to transmit or block the static elimination light by controlling orientation direction of the liquid crystal molecules, and the controller controls the static eliminator at the time of the image formation operation of the image forming unit so as to:

set the orientation direction of the liquid crystal molecules parallel to a transmission direction of the static elimination light, by applying a first electric field to the pair of substrates provided in the light shield unit corresponding to the photoconductor on which the image formation is being performed, among the plurality of photoconductors, to thereby transmit the static elimination light along the orientation direction of the liquid crystal molecules; and set the orientation direction of the liquid crystal molecules perpendicular to the transmission direction of the static elimination light, by applying a second electric field to the pair of substrates provided in the light shield unit corresponding to the photoconductor on which the image formation is not being performed, among the plurality of photoconductors, to thereby cause the liquid crystal molecules to block the static elimination light.

* * * * *